US009127500B2

(12) United States Patent
Huang

(10) Patent No.: US 9,127,500 B2
(45) Date of Patent: Sep. 8, 2015

(54) CORD-WINDING DEVICE FOR VENETIAN BLIND

(71) Applicant: Taicang Kingfu Plastic Manufacture Co., Ltd., Jiangshu Province (CN)

(72) Inventor: Szu-Chang Huang, Changhua County (TW)

(73) Assignee: Taicang Kingfu Plastic Manufacture Co., Ltd., Jiangshu Province (CN)

( * ) Notice: Subject to any disclaimer, the term of this patent is extended or adjusted under 35 U.S.C. 154(b) by 0 days.

(21) Appl. No.: 14/296,269

(22) Filed: Jun. 4, 2014

(65) Prior Publication Data

US 2015/0136336 A1 May 21, 2015

(30) Foreign Application Priority Data

Nov. 15, 2013 (CN) ..... 2013 2 0723734 U

(51) Int. Cl.
*E06B 9/30* (2006.01)
*E06B 9/322* (2006.01)

(52) U.S. Cl.
CPC ..... *E06B 9/322* (2013.01)

(58) Field of Classification Search
CPC . E06B 9/322; E06B 9/325; E06B 2009/3222; E05D 13/1276
USPC ..... 160/170, 171, 178.1 R, 173 R, 84.01, 160/84.04
See application file for complete search history.

(56) References Cited

U.S. PATENT DOCUMENTS

| | | | | |
|---|---|---|---|---|
| 4,513,805 | A * | 4/1985 | Mase | 160/299 |
| 6,443,210 | B1 * | 9/2002 | Welfonder | 160/313 |
| 6,571,853 | B1 * | 6/2003 | Ciuca et al. | 160/170 |
| 6,644,375 | B2 * | 11/2003 | Palmer | 160/170 |
| 7,406,995 | B2 * | 8/2008 | Huang | 160/170 |
| 8,051,960 | B2 * | 11/2011 | Nakajima | 188/82.7 |
| 8,448,767 | B2 * | 5/2013 | Ando | 192/45.008 |
| 8,893,763 | B2 * | 11/2014 | Huang | 160/170 |
| 2002/0088562 | A1 * | 7/2002 | Palmer | 160/170 |
| 2003/0111189 | A1 * | 6/2003 | Palmer et al. | 160/170 |
| 2006/0278348 | A1 * | 12/2006 | Huang | 160/170 |
| 2007/0227677 | A1 * | 10/2007 | Yu et al. | 160/170 |
| 2008/0314530 | A1 * | 12/2008 | Cheng | 160/170 |
| 2009/0283223 | A1 * | 11/2009 | Liu | 160/84.02 |
| 2013/0032300 | A1 * | 2/2013 | Yu et al. | 160/84.02 |
| 2014/0083631 | A1 * | 3/2014 | Huang | 160/170 |
| 2014/0224431 | A1 * | 8/2014 | Lin | 160/84.01 |
| 2014/0291431 | A1 * | 10/2014 | Huang | 242/372 |

* cited by examiner

*Primary Examiner* — Katherine Mitchell
*Assistant Examiner* — Scott Denion
(74) *Attorney, Agent, or Firm* — Osha Liang LLP

(57) ABSTRACT

A cord winding device for a Venetian blind includes a receiving unit, a resilient driving unit mounted in the receiving unit, a braking unit mounted in the receiving unit and adjacent to the resilient driving unit, and a unidirectional damping unit mounted in the receiving unit. Through cooperation between the braking unit and the resilient driving unit, during winding and unwinding of pull cords, a bottom rail can be descended slowly and stopped conveniently at any desired height.

10 Claims, 10 Drawing Sheets

CORD-WINDING DEVICE FOR VENETIAN BLIND

BACKGROUND OF THE INVENTION

1. Field of the Invention

This invention relates to a Venetian blind, and more particularly to a cord winding device for a Venetian blind.

2. Description of the Related Art

Referring to FIGS. 1 and 2, a Venetian blind disclosed in U.S. Pat. No. 406,995 includes a head rail 1, a bottom rail 2, a plurality of slats 3 disposed between the head rail 1 and the bottom rail 2, two pull cords 4 connected to the head rail 1 and the bottom rail 2 and extending through the slats 3, and a cord winding device 5 mounted in the head rail 1.

The cord winding device 5 includes a support 6 fixed in the head rail 1, a resilient driving unit 7 mounted on the support 6, and a braking unit 8.

The resilient driving unit 7 includes first and second reels 701, 702, a driving wheel 703 disposed between the first and second reels 701, 702, a spring winding wheel 704 disposed between the driving wheel 703 and the second reel 702, and a spiral spring 705 disposed between the driving wheel 703 and the spring winding wheel 704. Four gears 706 are connected respectively to the first and second reels 701, 702, the driving wheel 703, and the spring winding wheel 704. Any two adjacent gears 706 mesh with each other.

The braking unit 8 includes a braking wheel 801 and a braking mechanism 802 disposed between the braking wheel 801 and one of the pull cords 4 for controlling geared connection between the braking wheel 801 and the first reel 701.

The bottom rail 2 can be stopped at any desired height. However, if the size of the Venetian blind is comparatively large such that the total weight of the slats 3 and the bottom rail 2 is greater than the return force of the spiral spring 705, since the bottom rail 2 is not braked during lowering of the bottom rail 2, downward movement speed of the slats 3 and the bottom rail 2 is relatively quick so that the bottom rail 2 may cause damage to a person or an article disposed under the Venetian blind, thereby affecting adversely safety during use.

To overcome this drawback, in an improved Venetian blind disclosed in CN202788572, the applicant proposes to add a unidirectional clutch and a damping unit to the Venetian blind disclosed in U.S. Pat. No. 406,995, so as to retard downward movement of the bottom rail 2, thereby increasing safety during use. However, since a relatively large space is required for operation of the braking mechanism, its volume needs to be reduced.

SUMMARY OF THE INVENTION

The object of this invention is to provide a cord winding device for a Venetian blind, which can retard downward movement of slats and a bottom rail to promote safety during use, and which has the advantages of simple structure, and easy manufacture and assembly.

According to this invention, a cord winding device for a Venetian blind includes a receiving unit, a resilient driving unit mounted in the receiving unit, a braking unit mounted in the receiving unit and adjacent to the resilient driving unit, and a unidirectional damping unit mounted in the receiving unit. Through cooperation between the braking unit and the resilient driving unit, during winding and unwinding of pull cords, a bottom rail can be descended slowly and stopped conveniently at any desired height.

As such, downward movement of the slats and the bottom rail can be retarded by the unidirectional damping unit to promote safety during use.

Preferably, the unidirectional damping unit is located at a side of an assembly of a first reel and the braking unit, so that the total length of the cord winding device can be reduced.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
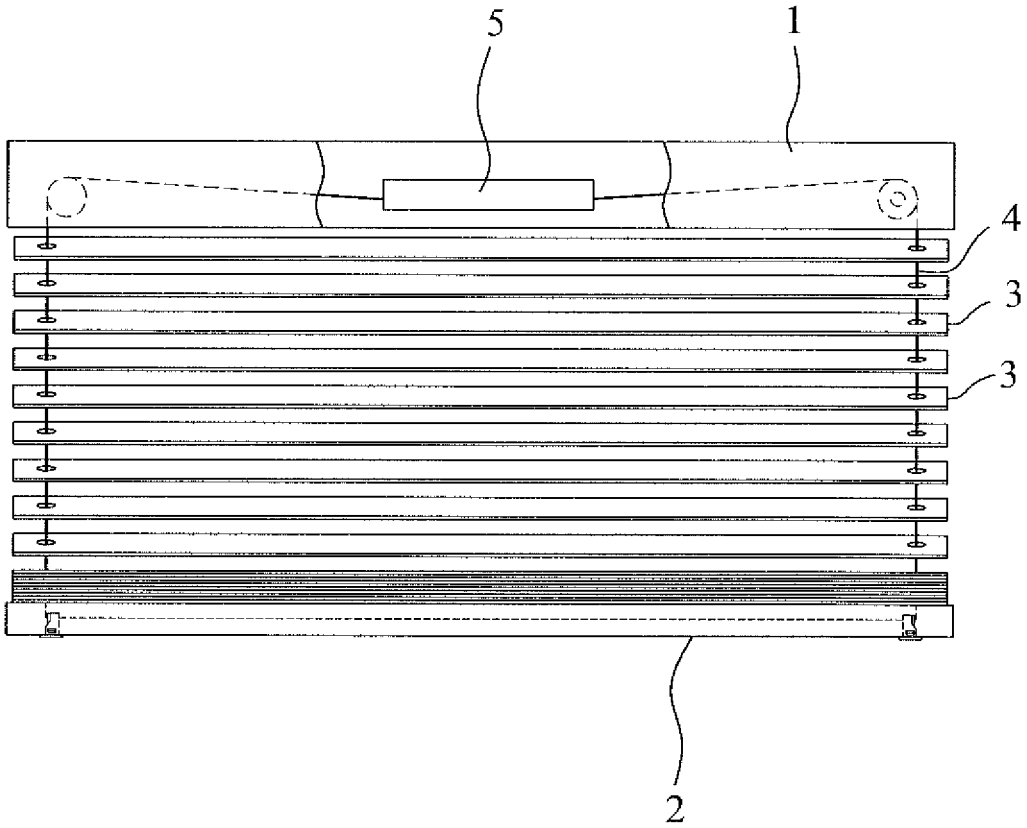
FIG.1 PRIOR ART
FIG. 1 is a schematic front view of a conventional Venetian blind disclosed in U.S. Pat. No. 7,406,995.
Figure 2:
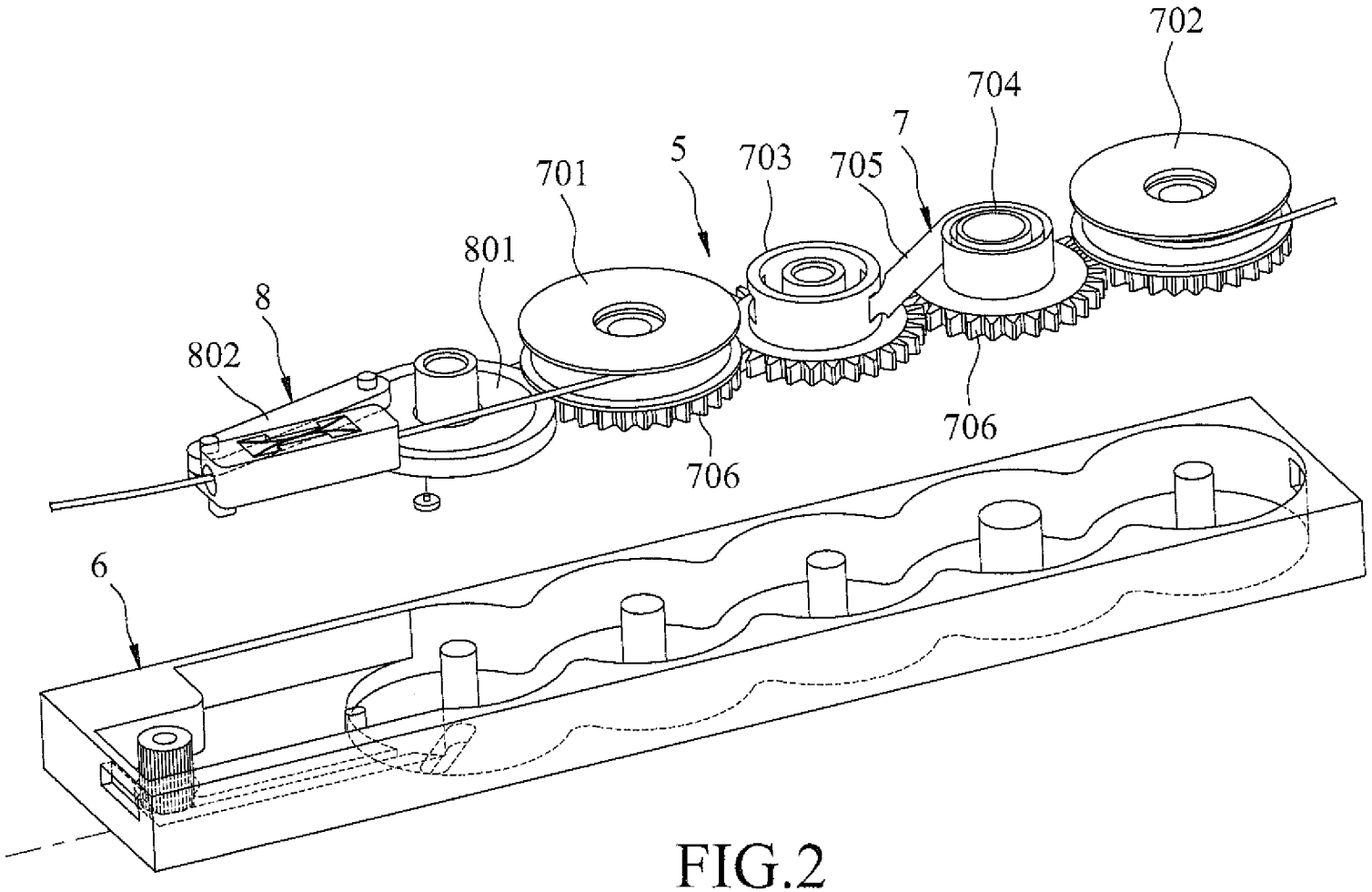
FIG.2 PRIOR ART
FIG. 2 is a fragmentary, partly exploded perspective view of the conventional Venetian blind.
Figure 3:
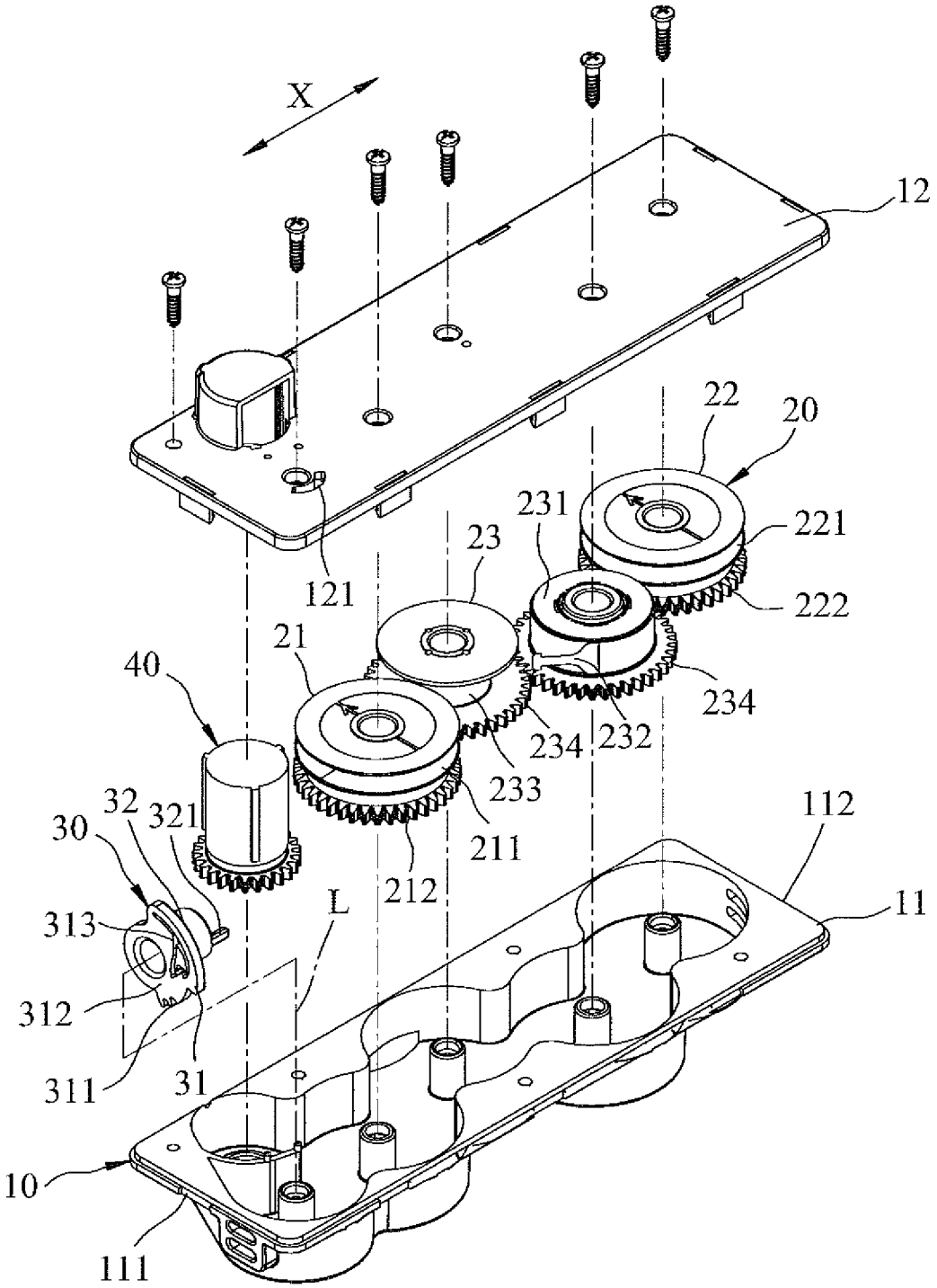
FIG. 3 is a partly exploded perspective view of the preferred embodiment of a cord winding device for a Venetian blind according to this invention.
Figure 4:
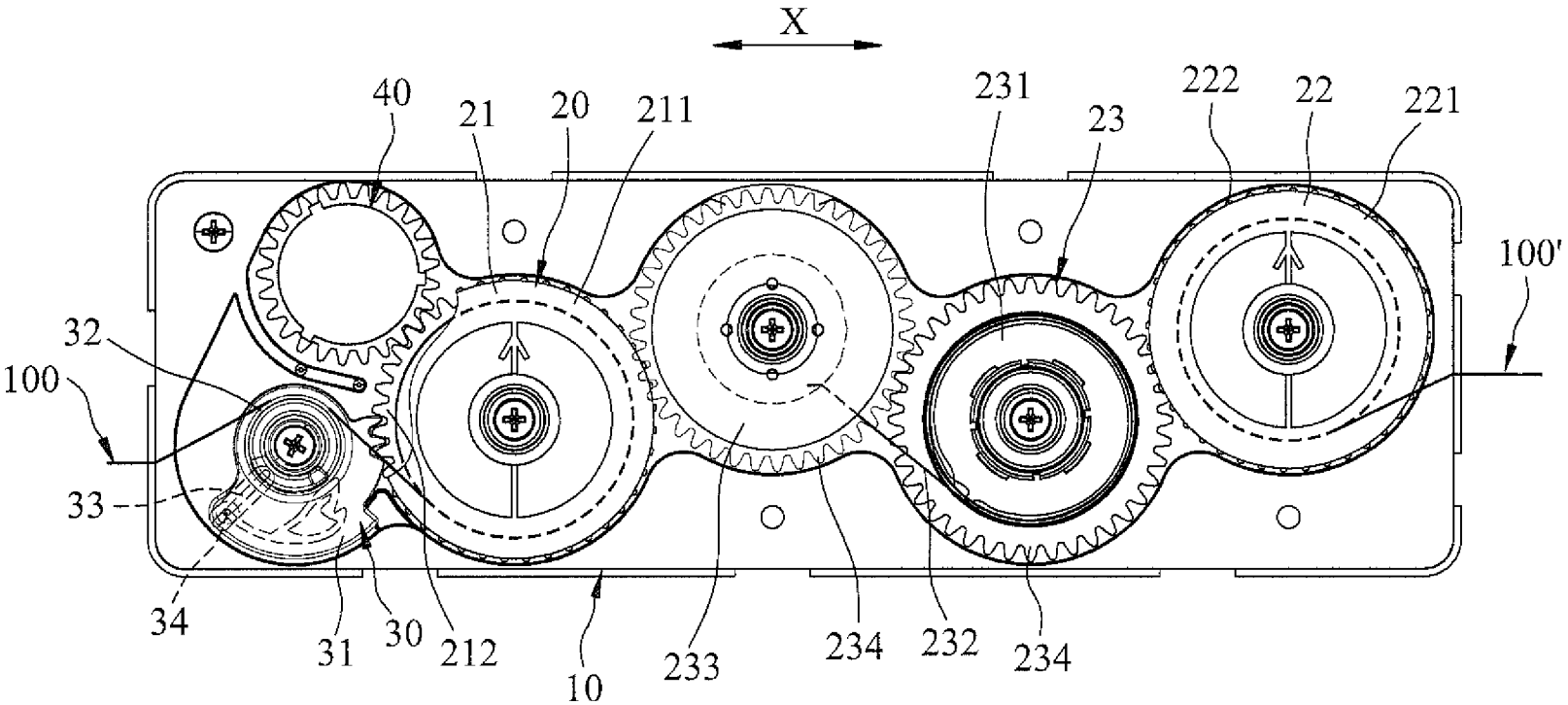
FIG. 4 is a schematic view of the preferred embodiment.

Referring to FIGS. 3 and 4, the preferred embodiment of a cord winding device according to this invention is used in a Venetian blind. The venetian blind includes a head rail (not shown), a bottom rail (not shown), a plurality of slats (not shown) disposed between the head rail and the bottom rail, and first and second pull cords 100 connected to the head rail and the bottom rail and extending through the slats. The cord winding device includes a receiving unit 10, a resilient driving unit 20 mounted in the receiving unit 10, a braking unit 30 mounted to the receiving unit 10 and adjacent to the resilient driving unit 30, and a unidirectional damping unit 40 mounted to the receiving unit 10.

The receiving unit 10 is mounted fixedly in the head rail, and includes a receiving seat 11 and an upper cover 12 disposed above and covering the receiving seat 11. The receiving seat 11 extends along a longitudinal direction (X), and has a first end 111 and a second end 112 that is opposite to the first end 111 along the longitudinal direction (X). The upper cover 12 is formed with a position limiting slot 121.

The resilient driving unit 20 is mounted in the receiving seat 11, and includes a first reel 21 disposed rotatably in the receiving unit 10, a second reel 22 disposed rotatably in the receiving unit 10, and a reel driving member 23 rotatable to drive rotation of the first and second reels 21, 22. The first and second pull cords 100, 100' are wound respectively the first and second reels 21, 22. The first reel 21 includes a first cord receiving wheel 211 connected with the first pull cord 100, and a first gear 212 connected to and coaxial with the first cord receiving wheel 211. The second reel 22 includes a second cord receiving wheel 221 connected with the second pull cord 100, and a second gear 222 connected to and coaxial with the second cord receiving wheel 221. The reel driving member 23 is disposed between the first and second reels 21, 22, and includes a spring winding wheel 231, a spiral spring 232 wound on the spring winding wheel 231 and fastened to the spring winding wheel 231 at one end of the spiral spring 232, a driving wheel 233 connected to the other end of the spiral spring 232, and two driving gears 234 connected respectively to the spring winding wheel 231 and the driving wheel 233 and meshing respectively with the first and second gears 212, 222. The driving gears 234 are coaxial respectively with the spring winding wheel 231 and the driving wheel 233. In this embodiment, rotating axes of any two adjacent ones of the first and second reels 21, 22, the spring winding wheel 231, and the driving wheel 233 are misaligned with each other along the longitudinal direction (X). The rotating axes of the first reel 21 and the spring winding wheel 231 are aligned with each other along the longitudinal direction (X). The rotating axes of the second reel 22 and the driving wheel 233 are aligned with each other along the longitudinal direction (X).

Figure 5:
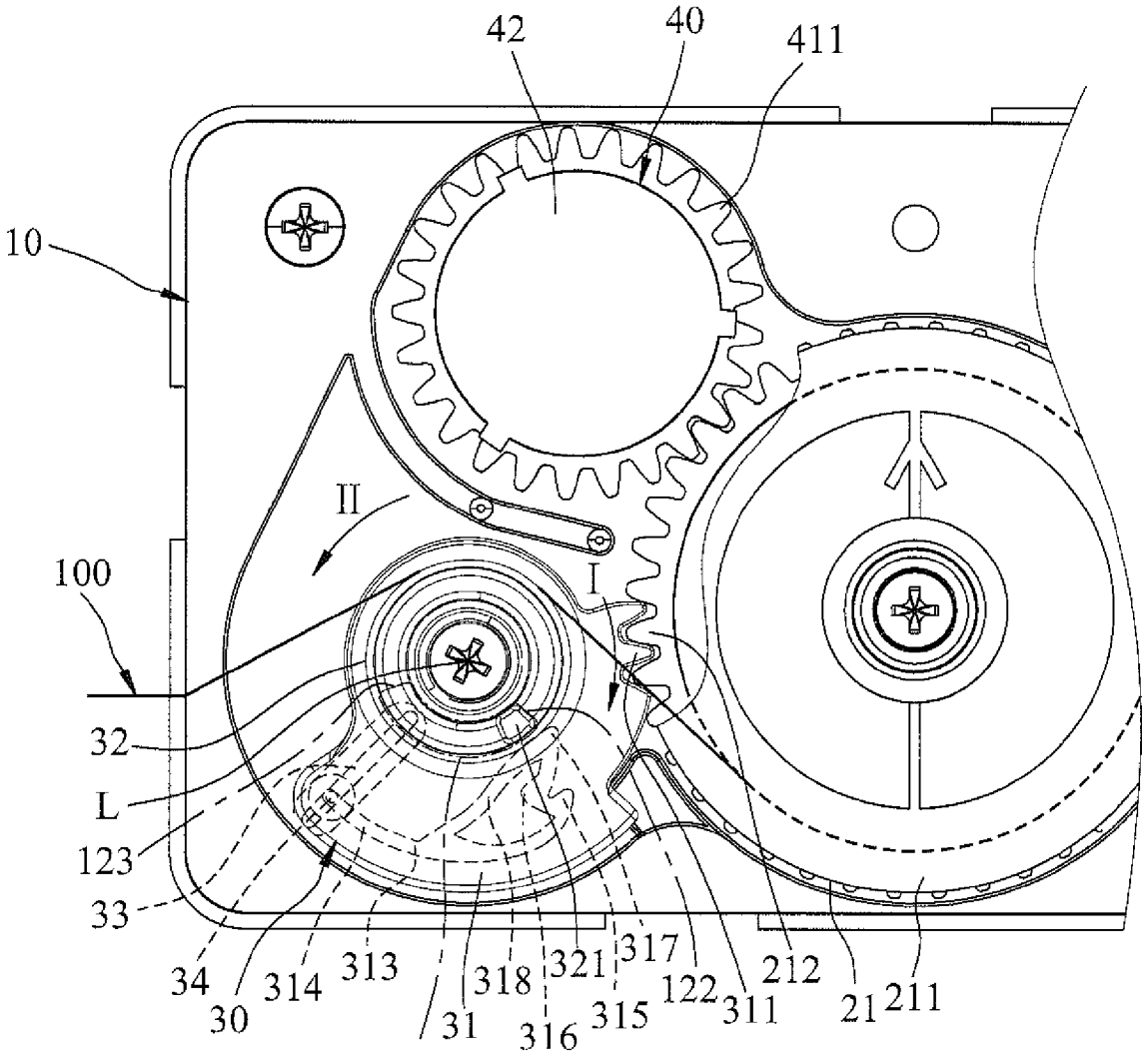
FIG. 5 is an enlarged view of a portion of FIG. 4, illustrating a braking state of a braking unit and a unidirectional idle rotation state of a unidirectional damping unit.

The braking unit 30 is mounted in the receiving seat 11, and is adjacent to the first reel 21. In this embodiment, the braking unit 30 includes: a braking plate 31 contactable with the first reel 11 to stop rotation of the first reel 11; a braking shaft 32 connected fixedly to the braking plate 31 and adapted for contact with the first pull cord 100 such that, upon movement of the first pull cord 100, the braking shaft 32 is rotated by the first pull cord 100; a straight slide slot 33 formed in the receiving unit 10; and a position limiting pin 34 disposed movably in the slide slot 33. The first pull cord 100 extends into the receiving unit 10 to contact frictionally the braking shaft 32, and is wound on the first reel 21. The braking plate 31 is rotatable in the receiving unit 10 about a vertical axis (L) perpendicular to the longitudinal direction (X), and has a plurality of teeth 311 rotatable to mesh with the first reel 21, a bottom surface 312 perpendicular to the vertical axis (L) and abutting against the receiving unit 10, and a guide slot 313 formed in the bottom surface 312. With further reference to FIG. 5, which illustrates a braking state of the braking unit 30 and a unidirectional idle rotation state of the unidirectional damping unit 40, the guide slot 313 has a curved slot section 314 extending around the vertical axis (L), a first stop slot section 315 connected to and disposed downstream of the curved slot section 314, a second stop slot section 316 connected to and disposed downstream of the first stop slot section 315, a third stop slot section 317 connected to and disposed downstream of the second stop slot section 316, and a return slot section 318 connected between the third stop slot section 317 and a middle portion of the curved slot section 314. When the teeth 311 of the braking plate 31 engage the first reel 21, the first stop slot section 315 extends from the curved slot section 314 away from the first reel 21 and toward the vertical axis (L), the second stop slot section 316 extends from the first slot section 315 toward the first reel 21 and the vertical axis (L), the third stop slot section 317 extends from the second slot section 316 away from the first reel 21, and the return slot section 318 extends from the third stop slot section 317 into the curved slot section 314 away from the first reel 21 and the vertical axis (L). Movement of the first pull cord 100 results in conversion of the teeth 311 of the braking plate 31 between an engaging state, where the teeth 311 mesh with the first reel 21, and a disengaging state, where the teeth 311 are spaced apart from the first reel 21. The cross-section of the braking shaft 32 has an arc that is adapted for contact with the first pull cord 100 and that has an angle not greater than 180°. The position limiting slot 121 has opposite closed first and second ends 122, 123, which are closed ends. The braking shaft 32 is provided with a position limiting rod 321 extending movably into the position limiting slot 121. The position limiting rod 321 is vertical, and is disposed above and connected to the braking shaft 32. However, to illustrate the guide slot 313, in FIG. 3, the position limiting rod 321 is shown to be horizontal such that the bottom surface 312 of the braking plate 31 is vertical.

Figure 6:
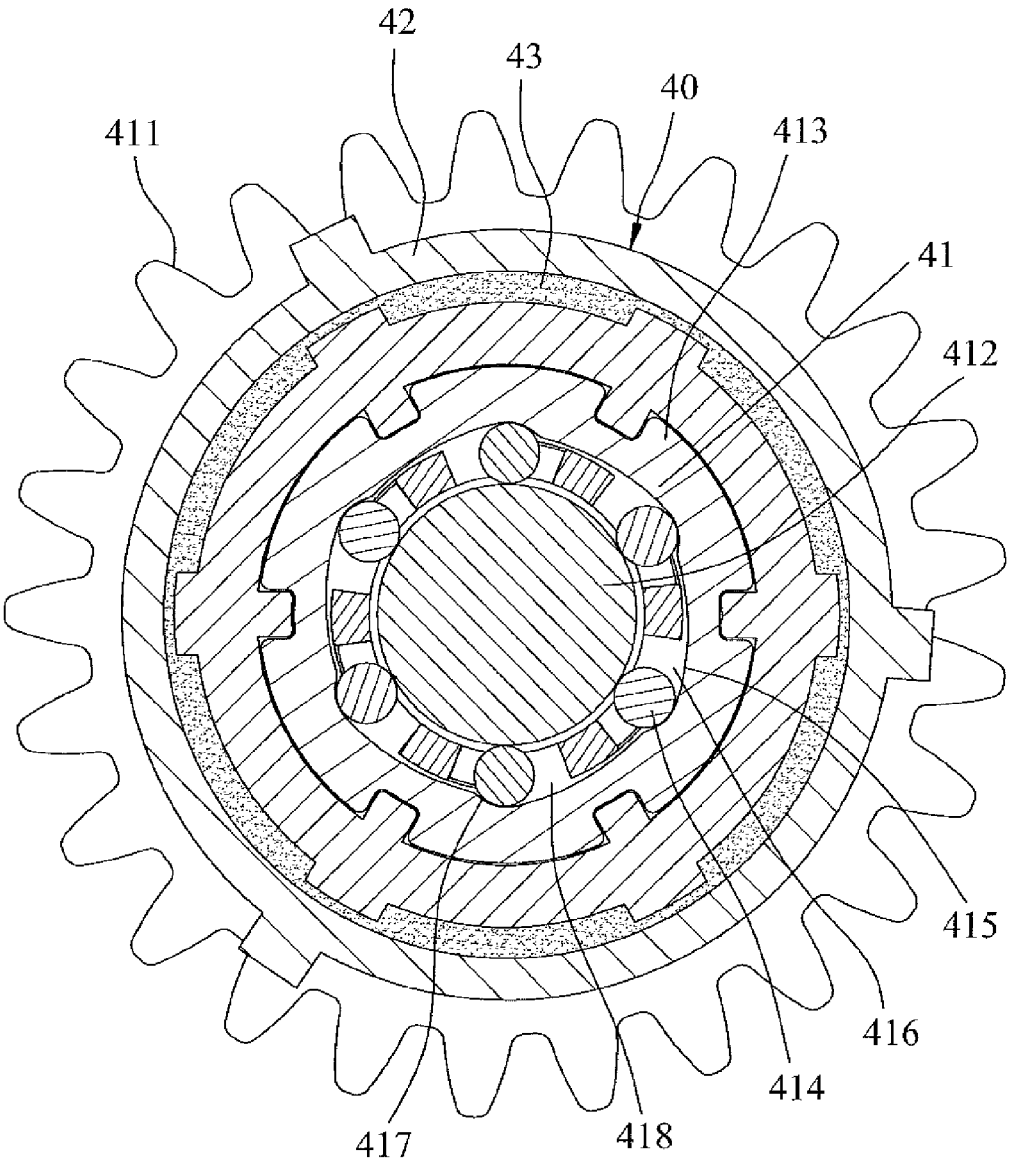
FIG. 6 is a sectional view of the unidirectional damping unit of the preferred embodiment, illustrating that a plurality of braking members are disposed respectively at deep ends of a plurality of curved grooves in the unidirectional damping unit.

The unidirectional damping unit 40 is located at aside of an assembly of the first reel 21 and the braking unit 30. With further reference to FIG. 6, the unidirectional damping unit 40 includes a unidirectional clutch 41 disposed pivotally on the receiving unit 10, a fixed outer shell 42 sleeved around the unidirectional clutch 41 and fixed on the receiving unit 10, and a damping fluid 43 disposed between the fixed outer shell 42 and the unidirectional clutch 41. The unidirectional clutch 41 has a driven wheel 411 braking unidirectionally the first reel 21, a rotating shaft 412 connected fixedly to the driven wheel 411, a cylinder 413 sleeved rotatably around the rotating shaft 412, and a plurality of braking members 414 disposed between the rotating shaft 412 and the cylinder 413. The driven wheel 111 meshes with the first gear 212 of the first reel 21. The cylinder 413 has a plurality of curved grooves 416 that are formed in an inner surface 415 thereof and that receive respectively and movably the braking members 414. Each curved groove 416 has a deep end 417 and a shallow end 418 that is opposite to the deep end 417 such that, when the corresponding braking member 414 is disposed in the deep end 417, the cylinder 413 is rotatable relative to the rotating shaft 412, and when the corresponding braking member 414 is disposed in the shallow end 418, the cylinder 413 is co-rotatable with the rotating shaft 412.

With particular reference to FIGS. 5 and 6, when the bottom rail is suspended and fixed at a desired height, the teeth 311 mesh with the first gear 212, the braking members 414 are disposed at the deep ends 417 of the curved grooves 416, the position limiting rod 321 is disposed at the first end 122 of the position limiting slot 121, and the position limiting pin 34 is disposed at an end of the curved slot portion 314 of the guide slot 33.

Figure 7:
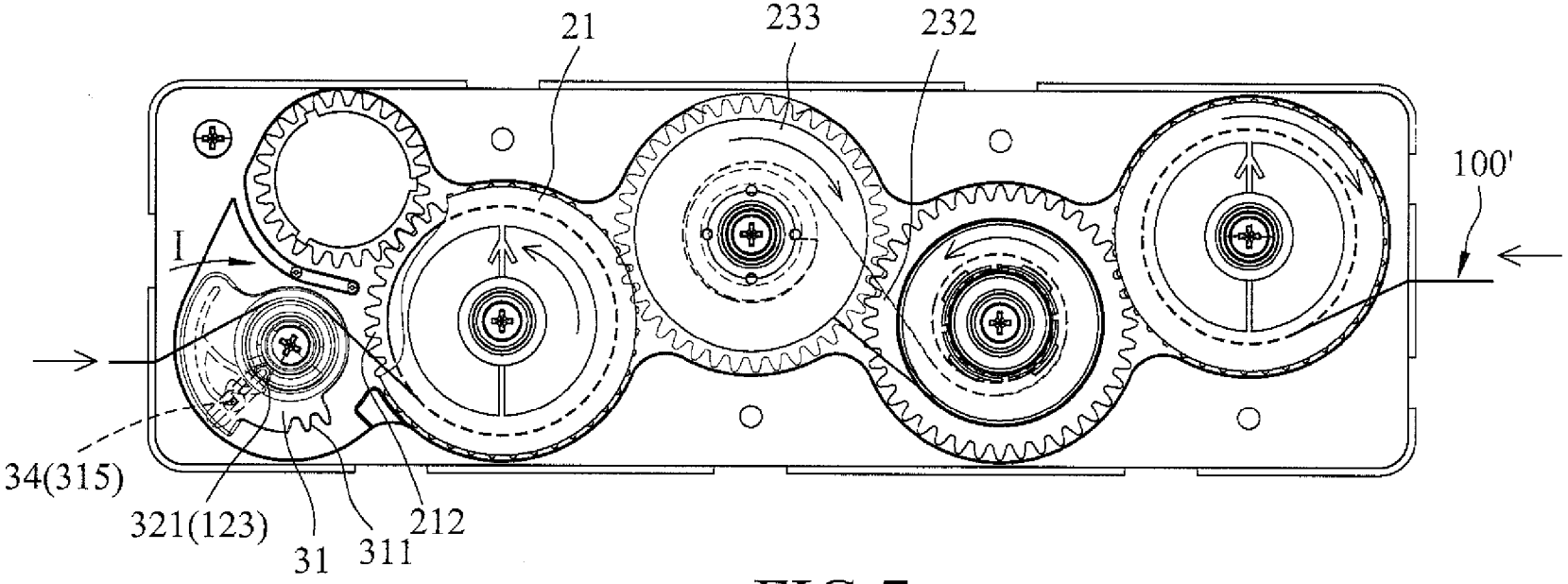
FIG. 7 is a view similar to FIG. 4 but illustrating that two pull cords are moved inwardly and wound to convert teeth of the braking unit into a disengaging state and the unidirectional damping unit is in the idle rotation state when a bottom rail is pushed upwardly.

With particular reference to FIGS. 4 and 5, when the slats are in a closed state such that the bottom rail is adjacent to the cord winding device, to open the slats, the bottom rail is first pushed to move upwardly slightly, so that a force applied to the spiral spring 232 by the weight of the slats and the bottom rail is removed. At this time, due to the return force of the spiral spring 232, the driving wheel 233 is rotated clockwise to drive counterclockwise rotation of the first reel 21. Hence, the braking plate 31 is rotated in a clockwise direction (I) until the first stop slot section 315 engages the position limiting pin 34, the teeth 311 are removed from the first gear 212, and the position limiting rod 321 is disposed at the second end 123 of the position limiting slot 121, as shown in FIG. 7.

Figure 8:
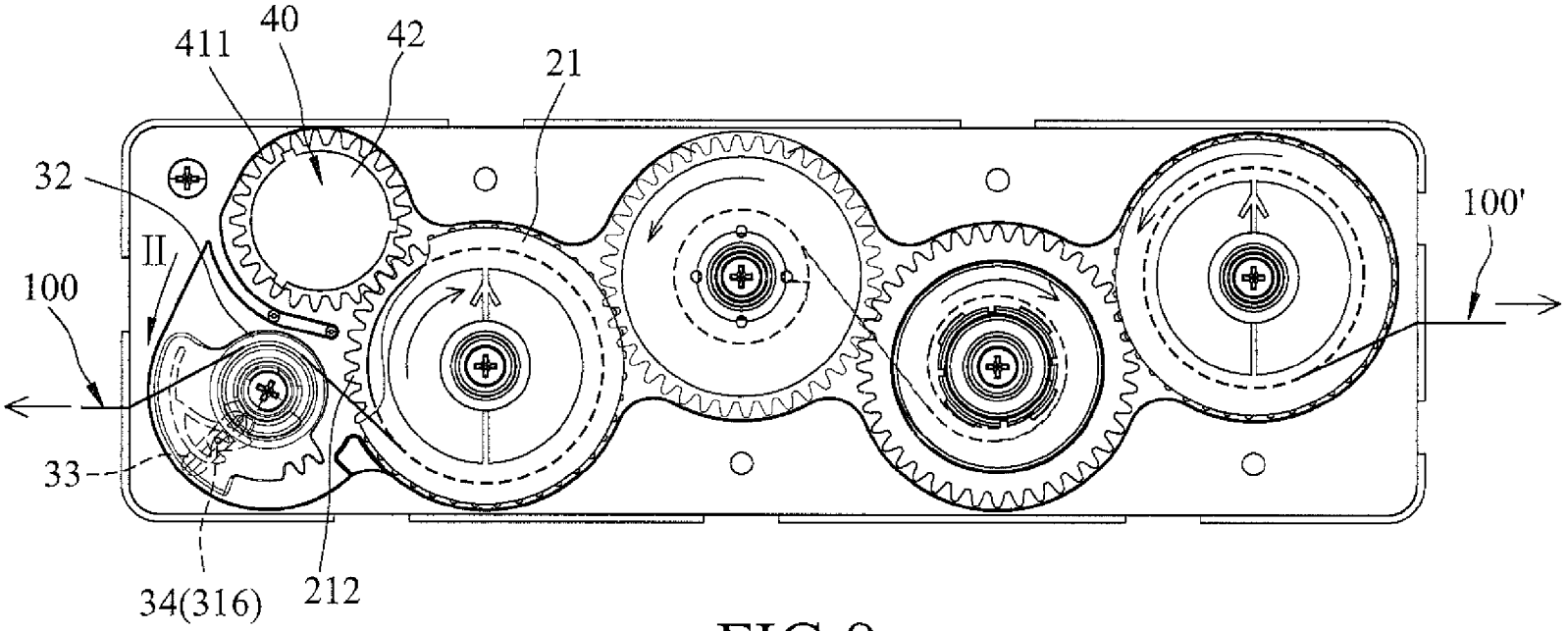
FIG. 8 is a view similar to FIG. 4 but illustrating outward movement of the pull cords, the disengaging state of the braking unit, and the idle rotation state of the unidirectional damping unit.
Figure 9:
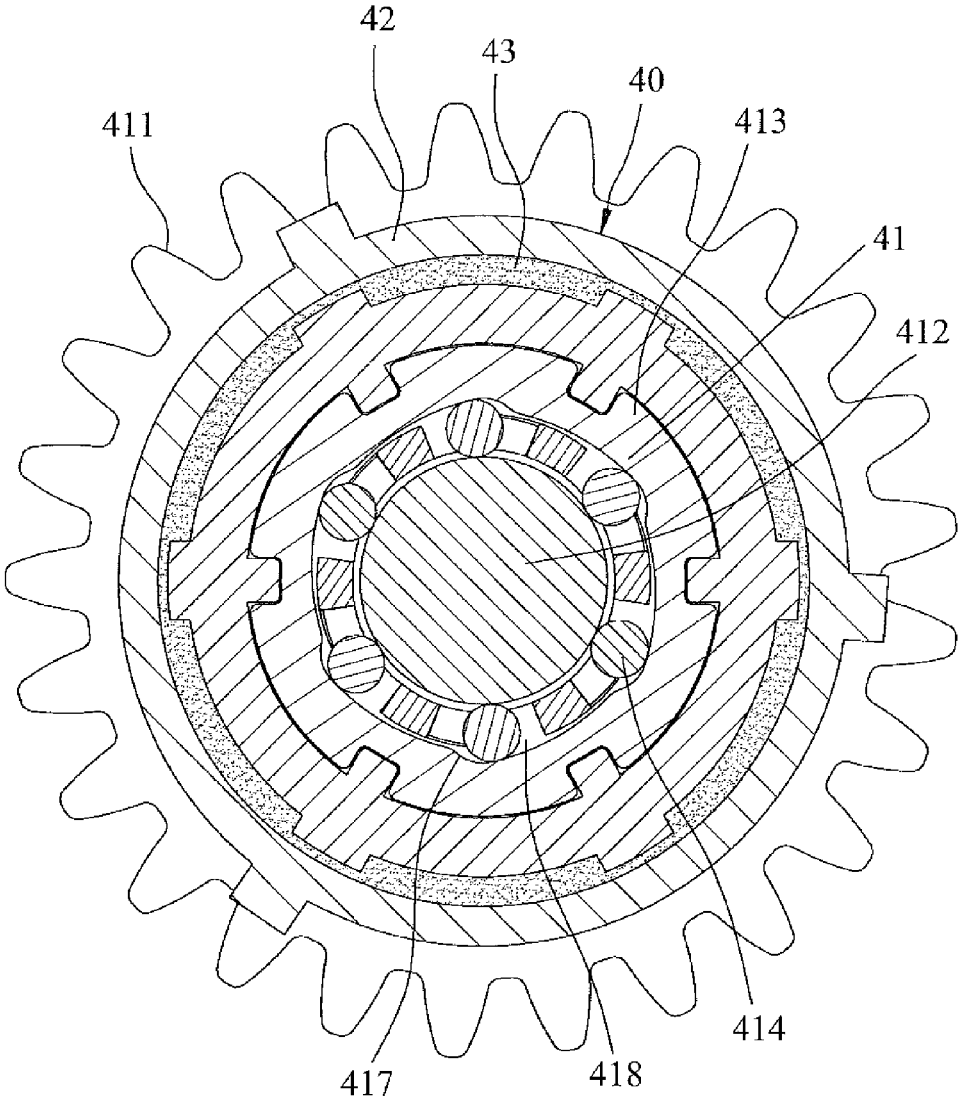
FIG. 9 is a view similar to FIG. 6 but illustrating that the braking members are disposed respectively at shallow ends of the curved grooves in the unidirectional damping unit.

Next, with particular reference to FIGS. 8 and 9, the bottom rail is pulled downwardly to move the first and second pull cords 100, 100' outwardly (i.e., unwind the first and second pull cords 100, 100'). At this time, due to a friction between the first pull cord 11 and the braking shaft 32 and cooperation between the position limiting pin 34 and the slide slot 33, the braking shaft 32 is rotated in a counterclockwise direction (II) by a small angle to allow the second stop slot section 316 to engage the position limiting pin 34. Upon continued outward movement of the first pull cord 100, the first reel 21 is rotated clockwise to thereby drive counterclockwise rotation of the driven wheel 411 and the rotating shaft 412 of the unidirectional damping unit 40, so that the braking members 414 are moved from the deep ends 417 to the shallow ends 418, thereby rotating the cylinder 413 relative to the fixed outer shell 42. Hence, rotation of the cylinder 413, the rotating shaft 412, and first reel 21 is retarded by the damping fluid 43, thereby reducing downward moving speed of the slats.

Figure 10:
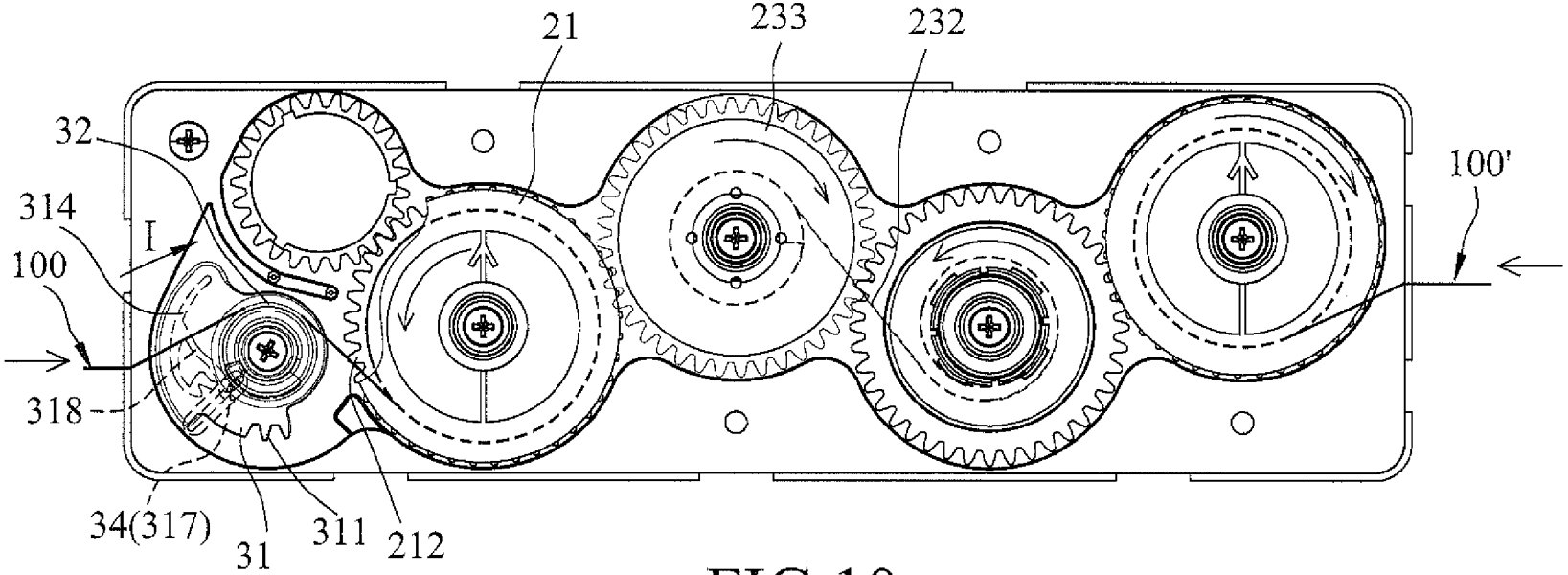
FIG. 10 is a view similar to FIG. 4 but illustrating that the pull cords are moved inwardly when the bottom rail is pushed upwardly slightly to engage a position limiting pin with a third stop slot section of a guide slot.

Referring to FIG. 10, when the bottom rail is descended to a desired height, it is pushed upwardly slightly to rotate the driving wheel 233 clockwise and the braking plate 31 in the clockwise direction (I), until the third stop slot section 317 engages the position limiting pin 34. Finally, the bottom rail is pulled downwardly slightly to rotate the braking shaft 32 in the counterclockwise direction (II). During counterclockwise rotation of the braking shaft 32, since the return slot section 318 extends from the third stop slot section 317 into the curved slot section 314 away from the first reel 21 and the vertical axis (L), the braking plate 31 is returned to its original position (as shown in FIG. 5) so as to allow the teeth 311 to mesh with the first gear 212, thereby stopping the bottom rail at the desired height.

Through the above operation, the bottom rail can be moved to and stopped at any desired position. Alternatively, a similar process may be provided to include the steps: pushing the bottom rail upwardly slightly, pulling the bottom rail downwardly slightly, pushing the bottom rail upwardly to a desired height, and pulling the bottom rail downwardly slightly. In this manner, the position limiting pin 34 also can pass through the first, second, third stop slot sections 315, 316, 317 and the return slot section 318. Furthermore, during closing of the slats, since the first gear 212 is rotated counterclockwise to drive clockwise rotation of the driven wheel 411 and the rotating shaft 412 to thereby move the braking members 414 from the shallow ends 418 to the deep ends 417, the slats can be closed quickly.

In view of the above, downward movement of the slats and the bottom rail can be retarded to promote safety during use. Furthermore, since the unidirectional damping unit 40 is located at a side of the assembly of the first reel 21 and the braking unit 30, and since any two adjacent ones of the first and second reels 21, 22 as well as the spring winding wheel 231 and the driving wheel 233 of the reel driving member 23 are misaligned from each other along the longitudinal direction (X), the length and volume of the cord winding device are reduced.

Alternatively, an arc of the braking shaft 32 in contact with the first pull cord 100 may have an angle not greater than 360°.

With this invention thus explained, it is apparent that numerous modifications and variations can be made without departing from the scope and spirit of this invention. It is therefore intended that this invention be limited only as indicated by the appended claims.

I claim:

1. A cord-winding device adapted for use in a Venetian blind, the Venetian blind including a head rail, a bottom rail, a plurality of slats disposed between the head rail and the bottom rail, and first and second pull cords extending through the slats and connected to the bottom rail, said cord-winding device being adapted to be mounted in the head rail and comprising a receiving unit, a resilient driving unit mounted in said receiving unit, a braking unit mounted in said receiving unit and adjacent to said resilient driving unit, and a unidirectional damping unit mounted in said receiving unit;

said resilient driving unit including a first reel rotatable relative to said receiving unit, a second reel rotatable relative to said receiving unit, and a reel driving member rotatable to drive rotation of said first and second reels, said first and second reels being adapted to permit the first and second pull cords to be wound respectively thereon;

said braking unit including a braking plate contactable with said first reel to stop rotation of said first reel, and a braking shaft connected fixedly to said braking plate and adapted to contact the first pull cord such that, upon movement of the first pull cord, said braking shaft is rotated by the first pull cord;

said unidirectional damping unit being located at a side of an assembly of said first reel and said braking unit and including a unidirectional clutch disposed pivotally on said receiving unit, a fixed outer shell sleeved on said unidirectional clutch and fixed on said receiving unit, and a damping fluid disposed between said fixed outer shell and said unidirectional clutch, said unidirectional clutch having a driven wheel braking unidirectionally said first reel.

2. The cord-winding device as claimed in claim 1, wherein said braking plate of said braking unit has a plurality of teeth rotatable to mesh with said first reel.

3. The cord-winding device as claimed in claim 2, wherein said braking unit further includes a slide slot formed in said receiving unit, and a position limiting pin disposed movably in said slide slot, said braking plate being rotatable in said receiving unit about an axis and further having a bottom surface perpendicular to said axis and abutting against said receiving unit, and a guide slot formed in said bottom surface, said guide slot having a curved slot section extending around said axis, a first stop slot section connected to said curved slot section and extending from an end of said curved slot section, a second stop slot section connected to and extending from an end of said first stop slot section that is distal from said curved slot section, a third stop slot section connected to and extending from an end of said second stop slot section that is distal from said first stop slot section, and a return slot section connected between said third stop slot section and said curved slot section such that, when said teeth of said braking plate mesh with said first reel, said first stop slot section extends from said curved slot section away from said first reel and toward said axis, said second stop slot section extends from said first slot section toward said first reel and said axis, said third stop slot section extends from said second slot section away from said first reel, and said return slot section extends from said third stop slot section into said curved slot section away from said first reel and said axis.

4. The cord-winding device as claimed in claim 3, wherein said braking shaft has an arc that is adapted for contact with the first pull cord and that has an angle not greater than 180°.

5. The cord-winding device as claimed in claim 3, wherein said braking shaft has an arc that is adapted for contact with the first pull cord and that has an angle not greater than 360°.

6. The cord-winding device as claimed in claim 3, wherein said first reel of said resilient driving unit includes a first cord receiving wheel adapted to be connected with the first pull cord, and a first gear connected to and coaxial with said first cord receiving wheel, and said second reel includes a second cord receiving wheel adapted to be connected with the second pull cord, and a second gear connected to and coaxial with said second cord receiving wheel, said reel driving member being disposed between said first and second reels and including a spring winding wheel, a spiral spring wound on said spring winding wheel and fastened to said spring winding wheel at one end of said spiral spring, a driving wheel connected to the other end of said spiral spring, and two driving gears connected respectively to said spring winding wheel and said driving wheel and meshing respectively with said first and second gears, said driving gears being coaxial respectively with said spring winding wheel and said driving wheel.

7. The cord-winding device as claimed in claim 6, wherein said driven wheel of said unidirectional clutch of said damping unit meshes with said first gear of said first reel.

8. The cord-winding device as claimed in claim 7, wherein said unidirectional damping unit further includes a rotating shaft connected fixedly to said driven wheel, a cylinder sleeved rotatably around said rotating shaft, and a plurality of braking members disposed between said rotating shaft and said cylinder, said cylinder having a plurality of curved grooves that are formed in an inner surface thereof and that receive respectively and movably said braking members, each of said curved groove having a deep end and a shallow end that is opposite to said deep end, said cylinder being rotatable relative to said rotating shaft when said braking members are disposed in said deep ends of said curved grooves, said cylinder being co-rotatable with said rotating shaft when said braking members are disposed at said shallow ends of said curved grooves.

9. The cord-winding device as claimed in claim 6, wherein said receiving unit extends along a longitudinal direction, and rotating axes of any two adjacent ones of said first and second reels, said spring winding wheel, and said driving wheel are misaligned from each other along said longitudinal direction.

10. The cord-winding device as claimed in claim 2, wherein said receiving unit includes a receiving seat and an upper cover disposed above and covering said receiving seat, said upper cover being formed with a position limiting slot having two closed ends, said braking shaft of said braking unit being provided with a position limiting rod extending movably into said position limiting slot.

* * * * *